US009416781B2

(12) United States Patent
Helbing et al.

(10) Patent No.: US 9,416,781 B2
(45) Date of Patent: Aug. 16, 2016

(54) GEAR PUMP INCLUDING FRICTION BRAKE RING TO GENERATE UNIFORM CONVEYANCE FLOW

(71) Applicant: OERLIKON TEXTILE GMBH & CO. KG, Remscheid (DE)

(72) Inventors: Ulrich Helbing, Burscheid (DE); Arkardiusz Tomzik, Bergisch Gladbach (DE); Dietrich Witzler, Rommerskirchen (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 230 days.

(21) Appl. No.: 13/626,045

(22) Filed: Sep. 25, 2012

(65) Prior Publication Data

US 2013/0034463 A1 Feb. 7, 2013

Related U.S. Application Data

(63) Continuation-in-part of application No. PCT/EP2011/054135, filed on Mar. 11, 2011.

(30) Foreign Application Priority Data

Mar. 25, 2010 (DE) ..... 10 2010 012 653

(51) Int. Cl.
*F04C 2/14* (2006.01)
*F04C 13/00* (2006.01)
*F04C 15/00* (2006.01)

(52) U.S. Cl.
CPC ..... *F04C 2/14* (2013.01); *F04C 15/0084* (2013.01); *F04C 13/005* (2013.01)

(58) Field of Classification Search
CPC ..... F04C 13/005; F04C 15/0084; F04C 2/14
USPC ..... 418/181, 206.6, 205
See application file for complete search history.

(56) References Cited

U.S. PATENT DOCUMENTS

| | | | | |
|---|---|---|---|---|
| 2,279,775 | A | 4/1942 | Brandenburg | |
| 5,299,676 | A * | 4/1994 | Wade | 192/223.3 |
| 6,183,231 | B1 * | 2/2001 | Van Norman | 418/206.6 |
| 2010/0278676 | A1 | 11/2010 | Tomzik et al. | |

FOREIGN PATENT DOCUMENTS

| | | | | |
|---|---|---|---|---|
| DE | 4408164 | A1 * | 9/1995 | F16C 19/54 |
| DE | 10 2005 059 563 | A1 | 12/2005 | |
| WO | WO 2008/113712 | | 9/2008 | |

OTHER PUBLICATIONS

English Machine Translation of DE 4408164 Al (translated on Dec. 4, 2015).*
PCT/EP2011/054135 International Preliminary Report on Patentability dated May 8, 2013 (6 pages including English translation).
PCT/EP2011/054135 International Search Report dated Mar. 5, 2013 (4 pages including English translation).

* cited by examiner

*Primary Examiner* — Kenneth Bomberg
*Assistant Examiner* — Paul Thiede
(74) *Attorney, Agent, or Firm* — Brinks Gilson & Lione; G Peter Nichols

(57) ABSTRACT

A gear pump includes a plurality of gear wheels rotatably retained in a pump housing and that engage in one another for the conveyance of a medium. One of the gear wheels is driven by a pump shaft, which can be coupled to a drive by means of a coupling end. To maintain a uniform conveyance flow, in particular with strongly fluctuating operational pressures, during alternating load states, within a single rotation, a brake ring is disposed on the circumference of the pump shaft, which acts with at least one brake surface on a friction surface of the pump shaft or on a friction surface of the pump housing.

9 Claims, 4 Drawing Sheets

GEAR PUMP INCLUDING FRICTION BRAKE RING TO GENERATE UNIFORM CONVEYANCE FLOW

This application is a continuation-in-part of and claims the benefit of priority from PCT application PCT/EP2011/054135 filed Mar. 18, 2011 and German Patent Application DE 10 2010 012 653.5 filed Mar. 25, 2010, the disclosure of each is hereby incorporated by reference in its entirety.

BACKGROUND

The invention relates to a gear pump.

It is generally known that to convey and dose liquid, gear pumps are used in which the medium to be conveyed is transported by means of two gear wheels that engage in one another between a pump intake and a pump discharge. Through the plurality of conveyance units a very uniform conveyance volume can be set, such that gear pumps of this type are preferably used for the generation of uniform conveyance quantities such as the supplying of lacquer in a lacquer facility.

A gear pump of this type is known, for example, from DE 10 2005 059 563 A1. With the known gear pump, two gear wheels that engage in one another within a pump housing are rotatably supported and connected to a pump shaft. The pump shaft extends with a coupling end from the pump housing and can be coupled to a drive shaft of a motor. In the use of gear pumps of this type, having variable pressure loads at the discharge end or the intake end, or both ends, irregularities in the conveyance flow have been observed. Normally, the gear wheels contained in the pump housing are driven by means of torque transferred to the pump shaft. In the case that, as a result of pressure fluctuations, a reversal of the pressure differences between the pump intake and the pump discharge occurs, in addition to the torque of the pump shaft, additional pressure forces act on the tooth surfaces of the gear wheels in the direction of conveyance, such that, depending on the size of the pressure forces applied to the gear wheels, a change from a motorized drive to an internally induced drive can result. In other words, in this situation, the pressure drop from the inlet of the pump to the outlet drives the pump faster than the motor. This change in the load direction is transferred to the entire drive train. Due to the torsional play in the drive train, accelerations then occur, followed by slowing of the rotational speed of the gear wheels within a single rotation of the pump shaft. This occurrence results directly in an irregularity in the conveyance flow during a rotation of the pump shaft.

SUMMARY

It is therefore an objective of the invention to provide a gear pump that, independently of the pressure relationships at the pump intake and the pump discharge, a conveyance flow can be generated that is uniform to the greatest degree possible.

This objective is attained according to the invention by disposing a brake ring on the circumference of the pump shaft which acts with at least one brake surface on a friction surface of the pump shaft or on a friction surface of the pump housing.

Advantageous developments of the invention are defined by the characteristics and combinations of characteristics in the embodiments described below.

The invention is distinguished in that a load reversal to the gear wheels through a braking torque acting on the pump shaft is absorbed and is not be transferred to the entire drive train. As a result only the play between the gear teeth and the gear wheels has an effect, which however affects the conveyance uniformity only to an insignificant degree. Another advantage of the invention is that defined and relatively high braking torques can be generated on the pump shaft independently of the selected gaskets within the pump.

Moreover, in typical known pumps, a higher frictional torque cannot be generated by means of sealing lips on the typical gasket, because the sealing lips seal breakdown within a short period of time. In this respect, the brake ring of the present invention provides the advantage that both the brake surface as well as the material of the brake ring can be adjusted for the generation of the braking torque. Depending on where the brake ring is installed, the corresponding friction surface can be formed on the pump shaft or on the pump housing.

Particularly preferred however, is the designing of the gear pump according to the invention in which the brake ring is retained in a non-rotational manner in the pump housing, and in which the brake surface is designed to correspond to an inner diameter of the brake ring.

In this case, the friction surface of the pump shaft is preferably formed on the circumferential peripheral surface, the outer diameter of which is larger than the inner diameter of the brake ring. In this manner it is possible to create a predefined pre-tension between the brake ring and the pump shaft.

Alternatively, the brake ring can be provided with a plurality of brake segments distributed uniformly on the inner diameter of the brake ring, each of which forms a sub-brake surface. In this manner, stick-slip effects between the brake ring and the pump shaft can advantageously be prevented.

In order, on the one hand, to enable a simple assembly, and, on the other hand, to obtain a defined pre-tensioning between the brake ring and the pump shaft, the design of the invention is preferably carried out in which the brake segments are molded onto a carrier ring to form a unitary component. The brake segments are disposed on the carrier such that they extend axially in a lateral direction and the brake segments are retained by means of an encompassing snap ring on the circumference of the pump shaft. In this manner, each of the brake segments is subjected to a uniform pressure via the snap ring on the circumference of the pump shaft, such that the sub-brake surfaces of the brake segments act together with the rotating friction surface of the pump shaft.

The design of the invention, in which the pump housing includes a plurality of housing plates and a shaft housing, is particularly suited for a subsequent integration in a gear pump of a brake ring of this type, wherein the pump shaft is located in the external housing plates, and extends into the shaft housing with the coupling end, and wherein the brake ring is disposed on a shaft section of the pump shaft within the shaft housing. By this means, there is the possibility of disposing the brake ring outside of the housing plates.

The design of the gear pump, in which a shaft gasket is provided within one of the housing plates and/or the shaft housing on the pump shaft, which is dedicated to the shaft section of the pump shaft between a bearing location and the brake ring, is particularly suited for higher drive pressures. In this manner, the functions between the gasket for the pump shaft and the braking of the pump shaft are clearly separated from one another. The sealing gasket formed on the circumference of the pump shaft can therefore be created and worked on such that it is independent of the rotating friction surface. In this manner, each section of the shaft can be optimally set for the relevant function of sealing or braking.

In order to absorb the pressure forces acting with respect to the brake ring on the pump shaft in the interior of the pump housing, the design of the gear pump according to the invention is particularly advantageous wherein a support bearing within the shaft housing is created for the radial and axial support of the pump shaft. The support bearing is dedicated for this purpose to the shaft section of the pump shaft between the brake ring and the coupling end.

It is also possible to dispose the brake ring on an external surface of the support bearing.

In order to further increase the functionality of the brake ring through the use of suitable materials, the brake ring may include an encompassing sealing lip which lies on the circumference of the pump shaft for sealing purposes and which is separated from the brake surface. In this manner, the two functions of braking the pump shaft and sealing the pump shaft can be combined and executed by means of a brake ring.

In this manner, advantageously high degrees of sealing can be implemented with respect to the coupling end of the pump shaft, wherein the brake ring and the shaft gasket form an annular space on the circumference of the pump shaft between one another, which can be filled with a sealing liquid, such that an additional barrier is formed. In addition, deposits to, and aging processes of the conveyance medium can be prevented. In this manner, gear pumps of this type are particularly suited for the conveyance and dosing of paints.

The gear pump according to the invention shall be explained below, based on some embodiment examples in greater detail, with respect to the attached figures.

DETAILED DESCRIPTION

Figure 1:
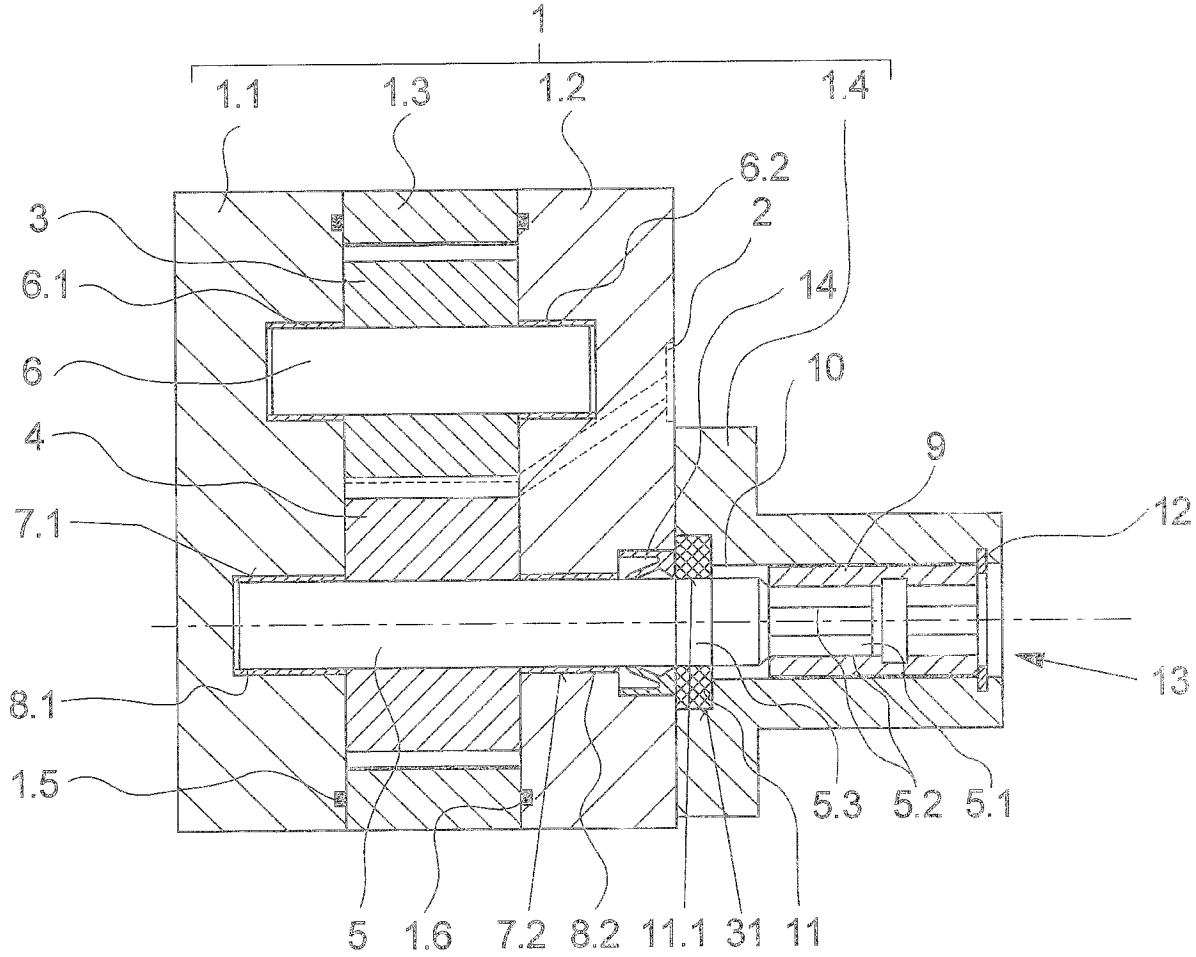
FIG. 1 schematically shows a cross-sectional view of a first embodiment of the gear pump according to the invention.

A first embodiment of the gear pump according to the invention is depicted in FIG. 1. The pump housing 1 is constructed of numerous pieces, and has a plurality of housing plates 1.1, 1.2, 1.3 as well as a shaft housing 1.4. A recess for two gear wheels 3 and 4, which engage in one another, is contained inside a central housing plate 1.3. The central housing plate 1.3 is contained together with the gear wheels 3 and 4 between the external housing plates 1.1 and 1.2. A gasket 1.5 and 1.6 is disposed in each of the end surfaces of the external housing plates 1.1 and 1.2, such that gaps between the central housing plate 1.3 and the external housing plates 1.1 and 1.2 are sealed from the exterior.

One of the gear wheels 3 is connected in a fixed manner to a rotatable bearing shaft 6. The bearing shaft 6 is retained in two bushings 6.1 and 6.2, which have been recessed in the external housing plates 1.1 and 1.2. The second gear wheel 4 is supported in a non-rotational manner on a pump shaft 5. The pump shaft 5 is supported at numerous shaft sections in the housing plates 1.1 and 1.2. For this purpose, the housing plate 1.1 has a first bearing bore 7.1 and the second housing plate 1.2 has a second bearing bore 7.2, in which the bearing bushings 8.1 and 8.2 are contained. The bearing bore 7.1 is designed as a blind hole in the housing plate 1.1. In contrast to this, the bearing bore 7.2 penetrates through the plate 1.2, such that the pump shaft 5 extends from the housing plate 1.2. The shaft section of the pump shaft 5 extending from the external housing plate 1.2 forms a coupling end 5.1 having a profiling 5.2 thereon.

A pump intake 2 and a pump discharge, not shown here, are disposed in the housing plate 1.2, which form, together with the gear wheels 3 and 4, a conveyance system for the dosed conveyance of a medium capable of flowing.

The shaft section of the pump shaft 5 extending outward from the housing plate 1.2 is encompassed by the shaft housing 1.4. The shaft housing 1.4 is connected in a rigid manner to the housing plate 1.2. A receiving hole 10 is formed inside of the shaft housing 1.4, in which a coupling sleeve 9 is inserted such that it can rotate. The coupling sleeve 9 is connected to the pump shaft 5 at an end surface via the profiling 5.2. At the opposite end, the coupling sleeve 9 has a profiled opening, such that it can be coupled to a drive shaft of a drive unit. The coupling sleeve 9 is held in the shaft housing 1.4 by means of a safety ring 12 having a receiving opening 13 in an axial extension toward the coupling sleeve 9. In this manner, the pump can be coupled to a drive unit via a plug and socket connection.

The shaft housing 1.4 has a hole 31 that is disposed concentrically to the pump shaft 5 on the side of the housing plate 1.2, in which a brake ring 11 is contained in a non-rotatable manner. The brake ring 11 has a brake surface 11.1 on its inner circumference, corresponding to a friction surface 5.3 formed on the pump shaft 5. The friction surface 5.3 has a circumferential peripheral surface. In one state, the inner diameter of the brake ring 11 in relation to the outer diameter of the pump shaft 5 in the shaft section of the friction surface 5.3 exhibits a defined reduced diameter, such that the brake ring 11 exerts a pressure on the pump shaft 5. In this manner, when the pump shaft 5 is rotated, a braking torque is generated via the brake ring 11.

In order to obtain a defined braking torque, the composition of the friction surface 5.3 on the pump shaft 5 and the composition of the brake surface 11.1 on the brake ring 11, and furthermore, the material of the brake ring 11, can be adapted to one another. Normally, the brake ring 11 is formed from a wear resistant plastic.

For the sealing of the pump housing 1, a shaft gasket 14 is provided inside the housing plate 1.2 in the region between the bearing bushing 8.2 and the brake ring 11, and at the pump shaft 5 section between the bearing location and the friction surface 5.3. The conveyance channel system formed between the housing plates 1.1, 1.2, 1.3 is sealed from the exterior in the region of the pump shaft 5 by means of the shaft gasket 14.

With the embodiment of the gear pump according to FIG. 1, the pump shaft 5 is operated via the coupling sleeve 9 by means of a drive coupled thereto having a predetermined rotation rate. In this state, the gear wheels 3 and 4 engage in one another and convey a medium that has been fed therein via the pump intake 2 in a continuous manner to a pump discharge. In the case that a discharge pressure existing at the pump discharge is greater than an intake pressure at the intake end of the pump, with each rotation of the pump shaft 5 a specific continuous conveyance flow is obtained by means of the gear wheels 3 and 4. In the case that, due to a drop in pressure, a reversal of the difference in pressures acting between the pump intake and the pump discharge occurs, additional hydraulic forces act on the gear wheels 3 and 4, which act in the direction of conveyance. For this, states may occur in which a lead with respect to the external drive results, i.e., shaft overrun results, which has an effect in the framework of the, structurally necessary, tolerance clearance. In order to keep operational states of this type within tight limits, a braking torque to the pump shaft 5 is continuously generated by means of the brake ring 11. The braking torque is configured such that an advance on the part of the pump shaft in relation to a drive shaft is prevented. In this manner, undesired load variances can be advantageously suppressed, such that conveyance flow fluctuations cannot occur during a rotation of the pump. By braking the pump shaft 5, advantageously uniform conveyance flows are obtained, even with fluctuations in the pressures between the pump intake and the pump discharge.

Depending on the design of the pump, different embodiments for the additional braking of the pump shaft can be used. As such, it would also be possible with the embodiment example according to FIG. 1 for the brake ring 11 to be connected to the pump shaft 5 in a non-rotatable manner, and to act together with an external brake surface on a friction surface formed in the shaft housing 1.4. The friction surface on the shaft housing in this case can be formed by means of a hole or the flanks of a groove. In practice, the alternative variation of the invention has, however, proven to be particularly successful, in which the brake ring is retained in a non-rotatable manner in a housing piece.

Figure 2:
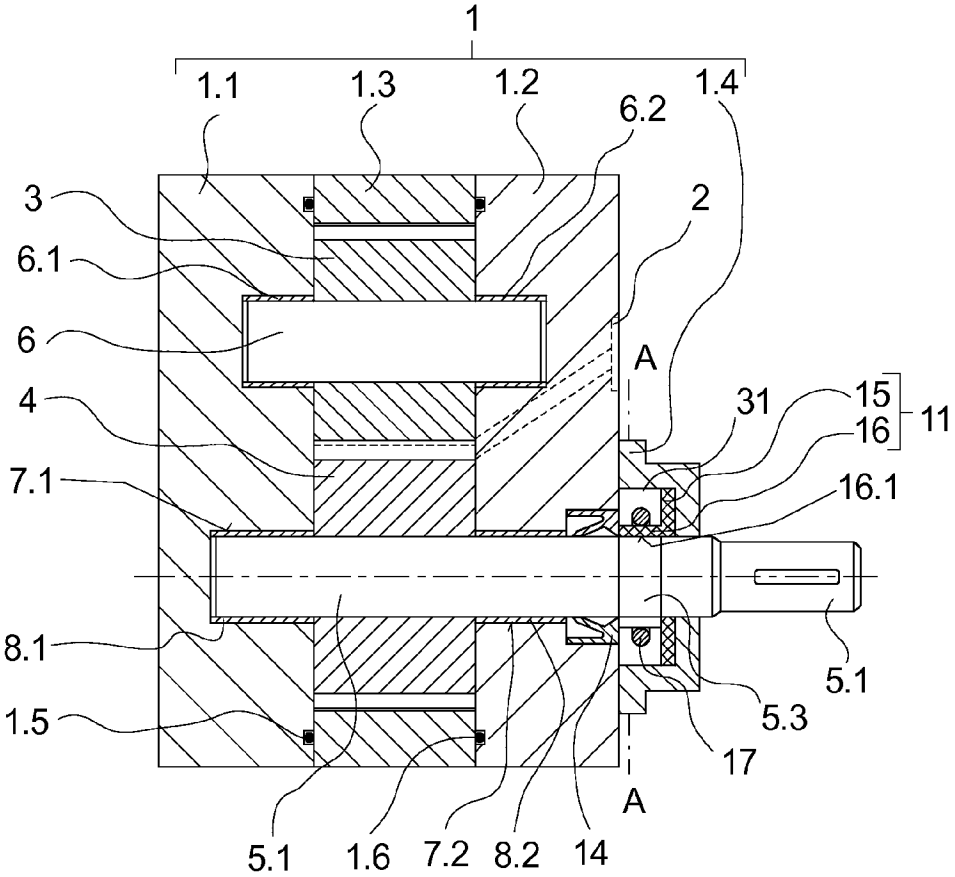
FIG. 2 schematically shows a cross-sectional view of another embodiment of the gear pump according to the invention.

Another embodiment of a gear pump according to the invention is depicted in FIG. 2, which is substantially identical to the embodiment according to FIG. 1, such that in the following, only the differences shall be explained, and otherwise, reference is made to the aforementioned description.

With the embodiment according to FIG. 2, the pump shaft 5 has a cylindrical coupling end 5.1, which extends from the shaft housing 1.4 and can be coupled to a drive unit by means of a fitted tongue.

A brake ring 11 is disposed on the pump shaft 5 in a shaft section between the coupling end 5.1 and a shaft gasket 14. The brake ring 11 is contained in a recess 31 of the shaft housing 1.4, in a non-rotatable manner.

Figure 3:
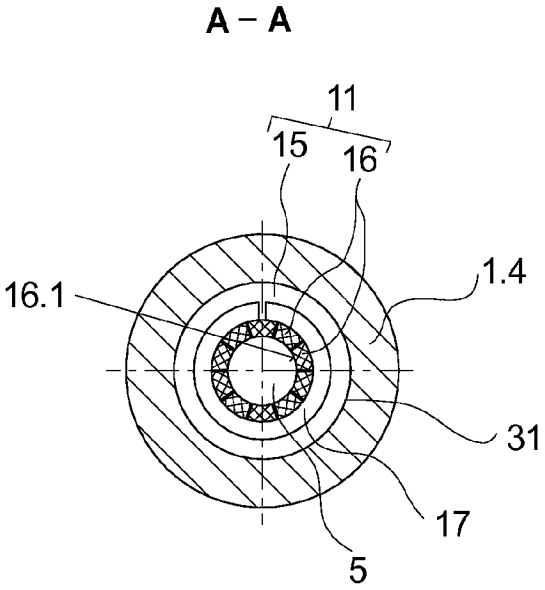
FIG. 3 schematically shows a sectional view along line A-A of FIG. 2 showing the brake ring on the circumference of the pump shaft.

For further explanation of the brake ring 11, reference is made, in addition to FIG. 2, to FIG. 3. FIG. 3 shows a sectional depiction of the brake ring 11 on the circumference of the pump shaft 5. In this respect, the following description applies to both FIGS. 2 and 3.

In this embodiment, the brake ring 11 is formed by a carrier ring 15 and a plurality of brake segments 16 disposed laterally on the carrier ring 15. The carrier ring 15 and the brake segments 16 are united as a single component, wherein the brake segments 16 are connected in an elastic manner to the carrier ring 15. The brake segments extend axially with respect to the carrier ring 15, and are distributed evenly over the circumference of the carrier ring 15. The individual brake segments 16 each have a sub-brake surface 16.1 on an inner surface, which rest against the circumference of the pump shaft 5, and which act together with the friction surface 5.3 of the pump shaft 5. In order to guide all of the brake segments 16 collectively onto the circumference of the pump shaft 5, a snap ring 17 is provided, which encompasses the brake segments 16 and retains the segments on the circumference of the pump shaft 5. Additional parameters are given as a result of the number of brake segments 16 retained on the carrier ring 15, and as a result of the radial expansion of the brake segments 16, for generating a specific braking characteristic to the pump shaft 5. With the depicted embodiment example, the brake segments 16 distributed on the circumference are designed to be identical and have a uniform spacing to one another in the radial direction. Both the symmetrical configuration of the brake segments as well as the spacings between the brake segments can be distributed differently over the circumference.

The function of the embodiment depicted in FIG. 2 is identical to the embodiment according to FIG. 1, such that no further explanation is required.

Figure 4:
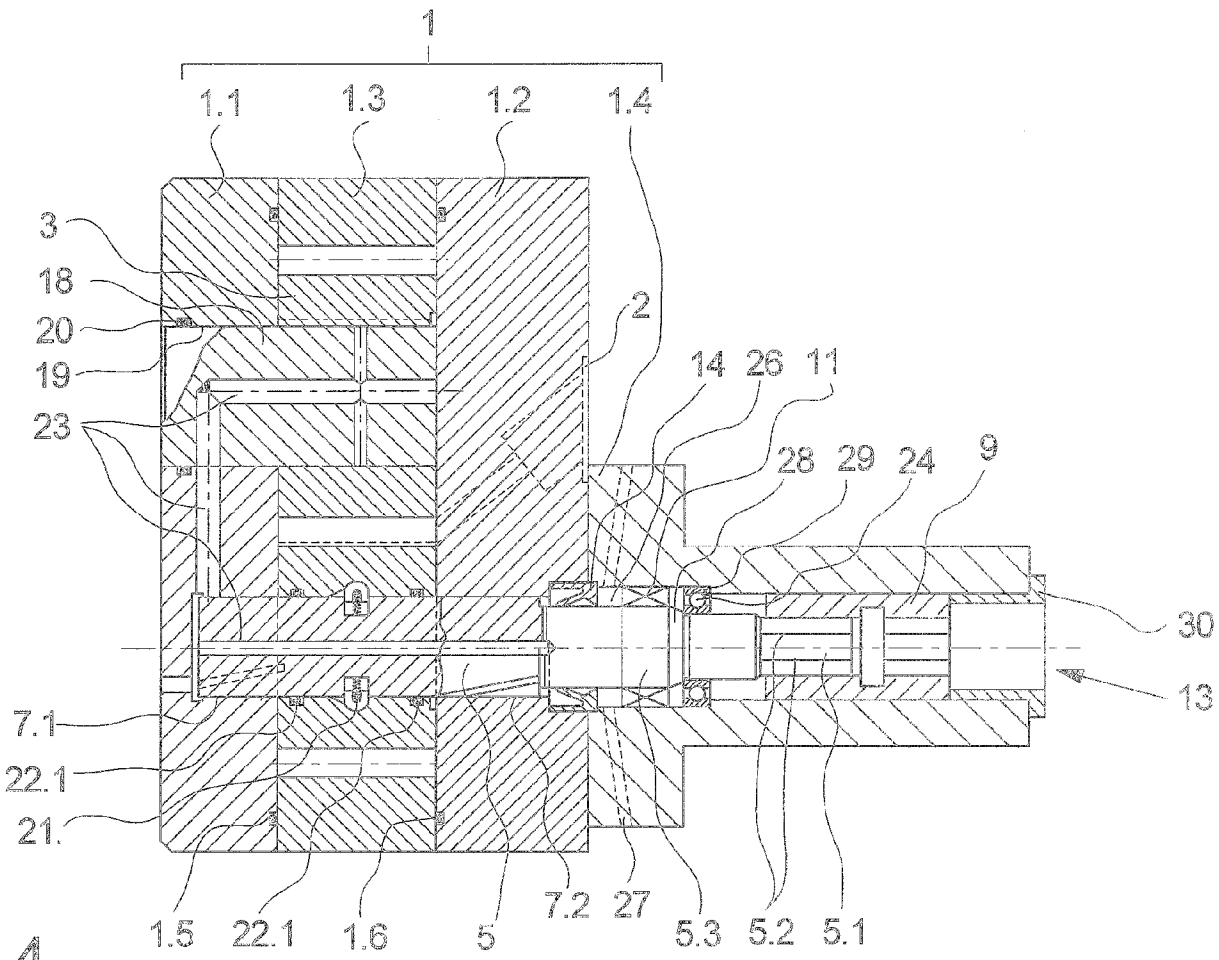
FIG. 4 schematically shows a cross-sectional view of another embodiment of the gear pump according to the invention.

Another embodiment of a gear pump according to the invention is depicted in FIG. 4, as it is preferably implemented for the dosing of lacquers in lacquer facilities.

With the embodiment according to FIG. 4, the pump housing 1 is also designed to have numerous pieces. The gear wheel 3 is supported on a bearing pin 18 in a rotatable manner in this embodiment, which is retained in a pin hole 19 in the external housing plate 1.1. A gasket 20, concentric to the bearing pin 18 is disposed in the housing plate 1.1, by means of which the pin hole 19 is sealed from the exterior.

The second gear wheel 4 is mounted directly on the circumference of the pump shaft 5 by means of a fastening agent 21. The axial gap formed between the circumference of the pump shaft 5 and the gear wheel 4 is sealed on both sides of the gear wheel 4 by means of O-rings 22.1 and 22.2. In this manner, on the one hand, entry of the conveyance medium into the gap between the gear wheel 4 and the pump shaft 5 is prevented, and on the other hand, a certain mobility of the gear wheel 4 on the pump shaft 5 is obtained, depending on the fastening agent 21 that is used. In this manner, the signs of wear caused in particular by the intake at the end surface between the gear wheel 4 and the housing plates 1.1 and 1.2 can be advantageously equalized, or minimized, respectively.

The pump shaft 5 is supported directly in the external housing plates 1.1 and 1.2. In this case, no bearing bushings are provided and the pump shaft 5 is guided directly into the bearing bores 7.1 and 7.2.

Moreover, numerous rinsing channels 23 are formed in the pump shaft 5, the housing plates 1.1 and 1.2, and the bearing pin 18, in order to be able to fully rinse the interior of the pump housing 1 for the purpose of changing the conveyance liquid. A rinsing system of this type for a gear pump is known from EP 1 164 293 A2, for example, such that at this point, reference can be made to the description given therein, and no further explanation thereto shall be given here.

There is a brake ring 11, and a support bearing 24 formed on the shaft section of the pump shaft 5 extending outside of the external housing plate 1.2, between the coupling end 5.1 and the location of a shaft gasket 14. The shaft gasket 14, the brake ring 11 and the support bearing 24 are supported, concentric to the pump shaft 5, by means of the shaft housing 1.4. The shaft housing 1.4 is connected to the housing plate 1.2 for this purpose in a fixed manner. With the embodiment in FIG. 4, the brake ring 11 is also formed by a carrier ring 15 and numerous lateral, molded brake segments 16.

Figure 5:
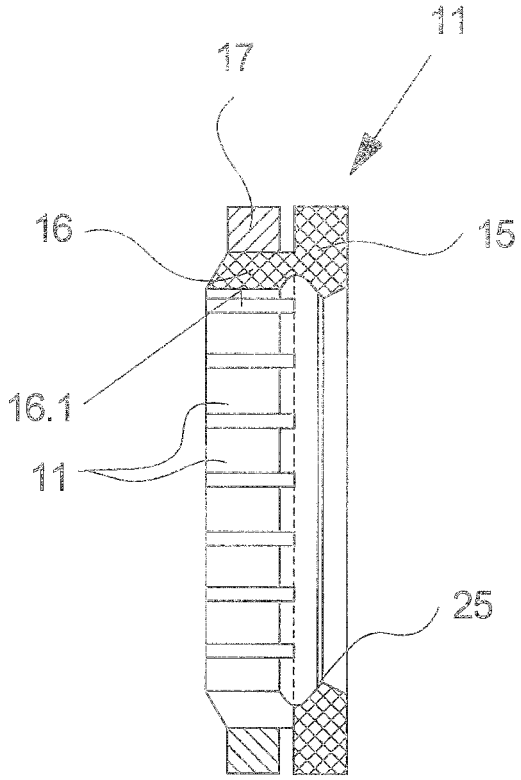
FIG. 5 schematically shows a cross-sectional view of a brake ring supported on the circumference of the pump shaft from the embodiment according to FIG. 4.

Turning now to FIG. 5, the brake ring 11 used in FIG. 4 is depicted. A cross-section view of the brake ring 11 is shown in FIG. 5. As can be seen in FIG. 5, the carrier ring 15 has an encircling sealing lip 24 on its inner circumference. The sealing lip 25 is designed to be spaced at a distance from the sub-brake surfaces 16.1 of the brake segments 16 on the brake ring 11, such that the brake ring 11 in this case executes a double function on the circumference of the pump shaft 5. First, the brake segments 16 provided on the carrier ring 15 are pressed by means of a snap ring 17 against the friction surface 5.3 of the pump shaft 5, in order to generate a braking torque. At the same time, the carrier ring 15 rests with its sealing lip 25, encircling its inner circumference, on the circumference of the pump shaft 5, next to the friction surface 5.3, and forms thereby a seal in the shaft housing 1.4 with respect to the coupling end 5.1.

With the embodiment depicted in FIG. 4, a closed annular space 26 within the shaft housing 1.4 is formed by means of the shaft gasket 14 and the brake ring 11. Channels 27 open into the annular space 26 through which a sealing liquid can be introduced in the annular space. The channels 27 in the shaft housing 1.4 can be sealed, such that when in operation, a sealing liquid can be contained within the annular space 26. Depending on the conveyance medium, a liquid containing a solvent is preferably used as the sealing liquid, in order to dissolve conveyance media exiting though leaks, in this case, lacquer, within the annular space 29, such that hardening and adhesion in the gaps is prevented.

The support bearing 24 formed between the coupling end 5.1 and the brake ring 11 is formed in this embodiment by means of a roller bearing, disposed between a shaft shoulder 28 on the pump shaft 5 and a housing projection 29 on the shaft housing 1.4. Forces acting in the axial direction on the pump shaft 5 can be advantageously absorbed by means of the shaft shoulder 28 and the housing projection 29. Likewise, the forces acting from outside, via the coupling end 5.1 of the pump shaft 5, can be absorbed by the support bearing 24, and not conducted to the interior of the pump housing 1.

The coupling end 5.1 of the pump shaft 5 is identical to the embodiment according to FIG. 1, and supports the coupling sleeve 9. For this, the coupling sleeve 9 in the receiving hole 10 of the shaft housing 1.4 is retained by means of a bearing sleeve 30, which at the same time represents a bearing for a detachable drive shaft. This can be inserted in the drive shaft via the receiving opening 13 at the end of the shaft housing 1.4, and can be connected to the pump shaft 5 by means of the coupling sleeve 9.

LIST OF REFERENCE SYMBOLS

1 pump housing
1.1 external housing plate
1.2 external housing plate
1.3 central housing plate
1.4 shaft housing
1.5 gasket
1.6 gasket
2 pump intake
3 gear wheel (passive)
4 gear wheel (driven)
5 pump shaft
5.1 coupling end
5.2 profiling
5.3 friction surface
6 bearing shaft
6.1, 6.2 bearing bushing
7.1, 7.2 bearing bore
8.1, 8.2 bearing bushing
9 coupling sleeve
10 receiving hole
11 brake ring
11.1 brake surface
12 safety ring
13 receiving opening
14 shaft gasket
15 carrier ring
16 brake segment
16.1 sub-brake segment
17 snap ring
18 bearing pin
19 pin hole
20 gasket
21 fastening agent
22.1, 22.2 O-ring
23 rinsing channel
24 support bearing
25 sealing lip
26 annular space
27 channel
28 shaft shoulder
29 housing projection
30 bearing sleeve
31 recess

What is claimed:

1. A gear pump comprising:

a plurality of gear wheels that engage with one another, for the conveyance of a medium and that are contained in a rotatable manner in a pump housing;

a pump shaft coupled to one of the gear wheels, wherein the pump shaft includes a coupling end;

a friction brake ring disposed about a circumference of the pump shaft and having at least one brake surface that continuously acts on a friction surface of the pump shaft, wherein the friction brake ring is retained in the pump housing such that the friction brake ring cannot rotate, and the at least one brake surface is formed on an inner circumference of the friction brake ring, and wherein the at least one brake surface contacts the friction surface of the pump shaft, an outer diameter of which is greater than an inner diameter of the friction brake ring.

2. The gear pump of claim 1 wherein the friction brake ring has at least two brake segments equidistantly distributed on the inner circumference of the friction brake ring each of which has a sub-brake surface.

3. The gear pump of claim 2 further comprising a radially extending carrier ring from which the at least two brake segments extend axially and a snap ring to hold the at least two brake segments about the circumference of the pump shaft.

4. The gear pump of claim 1 further comprising:

a plurality of housing plates including two external housing plates disposed on opposite sides of a central housing plate; and, a shaft housing disposed adjacent one of the two external housing plates, wherein the pump shaft is supported within the two external housing plates and the coupling end of the pump shaft extends into the shaft housing, and wherein the friction brake ring is disposed on a shaft section of the pump shaft within the shaft housing.

5. The gear pump of claim 4 further comprising a shaft gasket disposed on the pump shaft, the shaft gasket being located within one of the two external housing plates and/or being located within the shaft housing, wherein the shaft gasket is arranged between a bearing and the friction brake ring.

6. The gear pump of claim 5 wherein the friction brake ring has a sealing lip axially spaced from the at least one brake surface.

7. The gear pump of claim 6 wherein the friction brake ring and the shaft gasket are axially spaced on the pump shaft to form an annular space.

8. The gear pump of claim 4 further comprising a support bearing to radially and axially support the pump shaft and located within the shaft housing and between the friction brake ring and the coupling end.

9. The gear pump of claim 1 wherein the brake ring has a sealing lip axially spaced from the at least one brake surface.

* * * * *